US006715466B2

(12) United States Patent
Cotton, III et al.

(10) Patent No.: US 6,715,466 B2
(45) Date of Patent: Apr. 6, 2004

(54) METHOD AND APPARATUS FOR OPERATING AN INTERNAL COMBUSTION ENGINE EXHAUST VALVE FOR BRAKING

(75) Inventors: Clifford E. Cotton, III, Pontiac, IL (US); Richard H. Holtman, Dunlap, IL (US); Larry G. Waterfield, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 144 days.

(21) Appl. No.: 10/024,381

(22) Filed: Dec. 17, 2001

(65) Prior Publication Data

US 2003/0111044 A1 Jun. 19, 2003

(51) Int. Cl.[7] ..... F02D 13/04
(52) U.S. Cl. ..... 123/322; 123/90.11; 123/90.12
(58) Field of Search ..... 123/322, 321, 123/320, 323, 324, 90.12, 90.11

(56) References Cited

U.S. PATENT DOCUMENTS

| | | | | |
|---|---|---|---|---|
| 5,176,115 | A | | 1/1993 | Campion |
| 5,191,867 | A | | 3/1993 | Glassey |
| 5,255,650 | A | * | 10/1993 | Faletti et al. ..... 123/322 |
| 5,271,371 | A | | 12/1993 | Meints et al. |
| 5,375,576 | A | | 12/1994 | Ausman et al. |
| 5,463,996 | A | | 11/1995 | Maley et al. |
| 5,471,721 | A | | 12/1995 | Haertling |
| 5,479,890 | A | | 1/1996 | Hu et al. |
| 5,495,838 | A | | 3/1996 | Johnson, Jr. |
| 5,517,972 | A | | 5/1996 | Stockner |
| 5,537,975 | A | | 7/1996 | Cosma et al. |
| 5,537,976 | A | * | 7/1996 | Hu ..... 123/322 |
| 5,619,965 | A | | 4/1997 | Cosma et al. |
| 5,632,841 | A | | 5/1997 | Hellbaum et al. |
| 5,645,031 | A | * | 7/1997 | Meneely ..... 123/322 |
| 5,673,669 | A | | 10/1997 | Maley et al. |
| 5,680,841 | A | * | 10/1997 | Hu ..... 123/322 |
| 5,697,342 | A | | 12/1997 | Anderson et al. |
| 5,718,199 | A | | 2/1998 | Hu et al. |
| 5,829,397 | A | | 11/1998 | Vorih et al. |
| 5,839,453 | A | * | 11/1998 | Hu ..... 123/322 |
| 5,957,111 | A | | 9/1999 | Rodier |
| 6,293,237 | B1 | * | 9/2001 | Vorih ..... 123/90.12 |

* cited by examiner

*Primary Examiner*—Mahmoud Gimie
(74) *Attorney, Agent, or Firm*—Wood, Herron & Evans, LLP; Steve D Lundquist

(57) ABSTRACT

An exhaust valve apparatus for an internal combustion engine exhaust valve having a thermally prestressed bender actuator, which moves through a displacement in response to a command signal from a control unit. An actuator drive responsive to motion of the thermally prestressed bender actuator operates an exhaust valve actuator system, which, in turn, operates the exhaust valve. The thermally prestressed electroactive bender actuator and the exhaust valve actuator system operate the exhaust valve to effect engine compression braking.

29 Claims, 6 Drawing Sheets

METHOD AND APPARATUS FOR OPERATING AN INTERNAL COMBUSTION ENGINE EXHAUST VALVE FOR BRAKING

TECHNICAL FIELD

This invention relates generally to valve actuators and, more particularly, to an apparatus and method for accurately controlling movement of an internal combustion engine exhaust valve in a compression braking cycle.

BACKGROUND

Internal combustion engines, both two cycle and four cycle, utilize reciprocating intake valves to supply a combustible gas to a combustion chamber. Reciprocating exhaust valves are used to exhaust gasses of combustion from the combustion chamber. For many years, a camshaft driven by the main crankshaft of the engine exclusively controlled the operation of the intake and engine valves. With ever increasing demands for improved engine performance over the years, this fixed and inflexible operation of the intake and engine valves with respect to the combustion cycle of the engine proved to be a disadvantage. For example, it is often desirable to adjust the valve timing for different engine operating conditions and/or engine speeds.

In one such application, it is often desirable to use engine compression braking to provide supplemental braking for vehicles traveling down hills. With engine compression braking, the engine is used as an energy absorbing air compressor, and it is necessary to operate the exhaust valves independently of their normal power generating combustion cycle. Thus, the exhaust valves are operated by actuators independent of the rocker arms or other devices operating the exhaust valves during a power generation mode.

More specifically, in a known normal engine compression braking mode, the fuel system is turned off; and the exhaust valve is closed during the compression stroke in the normal manner. However, when the piston is close to the top-dead-center position, the exhaust valve is opened; and the compressed air is vented out of the exhaust system. Thus, energy is absorbed in the compression of the air, but the compressed air is released before the energy can be recovered by the engine.

In another known engine compression braking mode, the exhaust valve is opened near the end of a prior intake stroke, that is, around the bottom-dead-center position. After some crankshaft rotation, such as about 30° for example, the exhaust valve is again closed. Opening the exhaust valve at the end of the intake stroke admits a pulse of high pressure exhaust gases into the combustion chamber for a supercharging effect. The higher initial combustion chamber density then results in greater compression and greater braking power generated during the compression breaking event. As with the normal engine compression braking, the exhaust valve is again opened around the top-dead-center position to vent the compressed gases.

As will be appreciated, the operation of an exhaust valve during a compression braking operation is different than the exhaust valve operation during normal engine operation. In order to provide this varied valve operation, it is known to open and close the exhaust valves by electronically operated hydraulic actuators. The flow of hydraulic fluid to a hydraulic actuator is normally controlled by an electromagnetic solenoid. While such solenoids provide large forces and have long strokes, solenoids do have certain drawbacks. For example, first, during actuation, current must be continuously supplied to the solenoid in order to maintain the solenoid in its energized position. Further, to overcome the inertia of the armature and provide faster response times, a solenoid is driven by a stepped current waveform. A very large current is initially provided to switch the solenoid; and after the solenoid has changed state, the drive current is stepped down to a minimum value required to hold the solenoid in that state. Thus, a relatively complex and high power current driver is required.

In addition to requiring a relatively complex and high current power source, the requirement of continuous current flow to maintain the solenoid at its energized position leads to heating of the solenoid. The existence of such a heat source, as well as the ability to properly dissipate the heat, often is of concern depending on the environment in which the solenoid is used.

Second, the force produced by a solenoid is dependent on the air gap between the armature and stator and is not easily controlled by the input signal. This makes the solenoid difficult to use as a proportional actuator. Large proportional solenoids are common, but they operate near or at the saturation point and are very inefficient.

Third, small, relatively fast acting nonproportional solenoids may have response times defined by the armature displacement as fast as 350 microseconds. However, this response time can be a significant limitation in applications that require high repetition rates or closely spaced events. Further, it is known that there is a substantial delay between the start of the current signal and the start of the armature motion. This is due to the inductive delay between the voltage and magnetic flux required to exert force on the armature. In control systems, such delays lead to variability.

SUMMARY OF THE INVENTION

In accordance with the principles of the present invention, an electrohydraulic actuator for operating an exhaust valve of an internal combustion engine to provide engine compression braking is disclosed. A thermally prestressed electroactive bender actuator has at least two operating states and switches between those states in response to a command signal. An exhaust valve actuator system is coupled with the thermally prestressed electroactive bender actuator and the exhaust valve. The exhaust valve actuator system operates the exhaust valve as a function of the at least two operating states of the thermally prestressed electroactive bender actuator. The thermally prestressed electroactive bender actuator and the exhaust valve actuator system operate the exhaust valve to effect engine compression braking.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION

Figure 1:
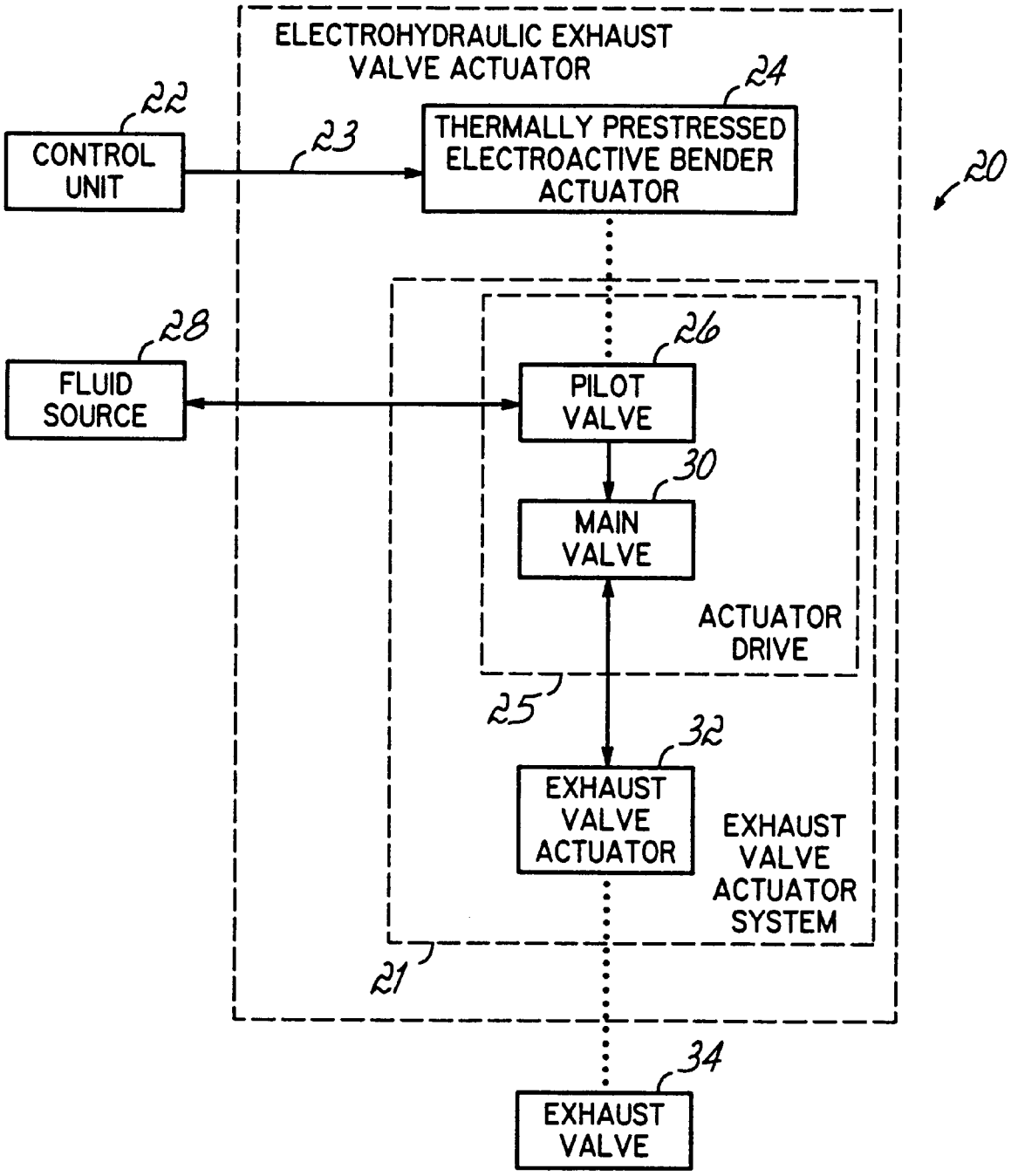
FIG. 1 is a schematic block diagram of an exhaust valve electrohydraulic actuator in accordance with one embodiment of the invention.

With reference to FIG. 1, an exhaust valve electrohydraulic actuator 20 according to one embodiment of the invention has an exhaust valve actuator system 21 operating in response to an electromechanical actuator, such as a thermally prestressed electroactive bender ("TPEB") actuator 24 for example. The exhaust valve actuator system 21 is comprised of an actuator drive 25 and an exhaust valve actuator 32. The actuator drive 25 is fluidly coupled to a source of pressurized fluid 28 and typically comprises a main valve 30 and a hydraulic pilot valve 26 responsive to the operation of the TPEB actuator 24. The actuator drive 25 controls the operation of an exhaust valve actuator 32 that, in turn, operates an exhaust valve 34.

In general, to operate the exhaust valve 34, an electronic control unit 22 operatively connected to the exhaust valve electrohydraulic actuator 20 provides a command signal to the TPEB actuator 24 causing the TPEB actuator 24 to move through a displacement and switch from a more domed, first state to a less domed, second state. In response thereto, the exhaust valve actuator system 21 switches from a first state to a second, valve operating state as a function of a change in state of the TPEB actuator 24. More specifically, the change in state of TPEB actuator 24 causes the actuator drive 25 to switch from a first state in which the exhaust valve actuator 32 is held in a first, inoperative to a second operating state that, in turn, causes the exhaust valve actuator 32 to switch to a second, operating state. Switching the exhaust valve actuator 32 between its states causes the exhaust valve 34 to be operated, that is, opened and closed.

In further detail, as the TPEB actuator 24 moves through its displacement, it also moves the hydraulic pilot valve 26. Movement of the hydraulic pilot valve 26 causes the hydraulic main valve 30 to change states, which, in turn, operates or switches the state of an exhaust valve actuator 32. The exhaust valve actuator 32 is typically mechanically coupled to the exhaust valve 34; and thus, the exhaust valve 34 is operated in response to the exhaust valve actuator 32 switching states. Thus, the bidirectional capability of the TPEB actuator 24 within the exhaust valve electrohydraulic actuator 20 may be used to switch a mechanical actuator 34, such as an exhaust valve for example.

Figure 2:
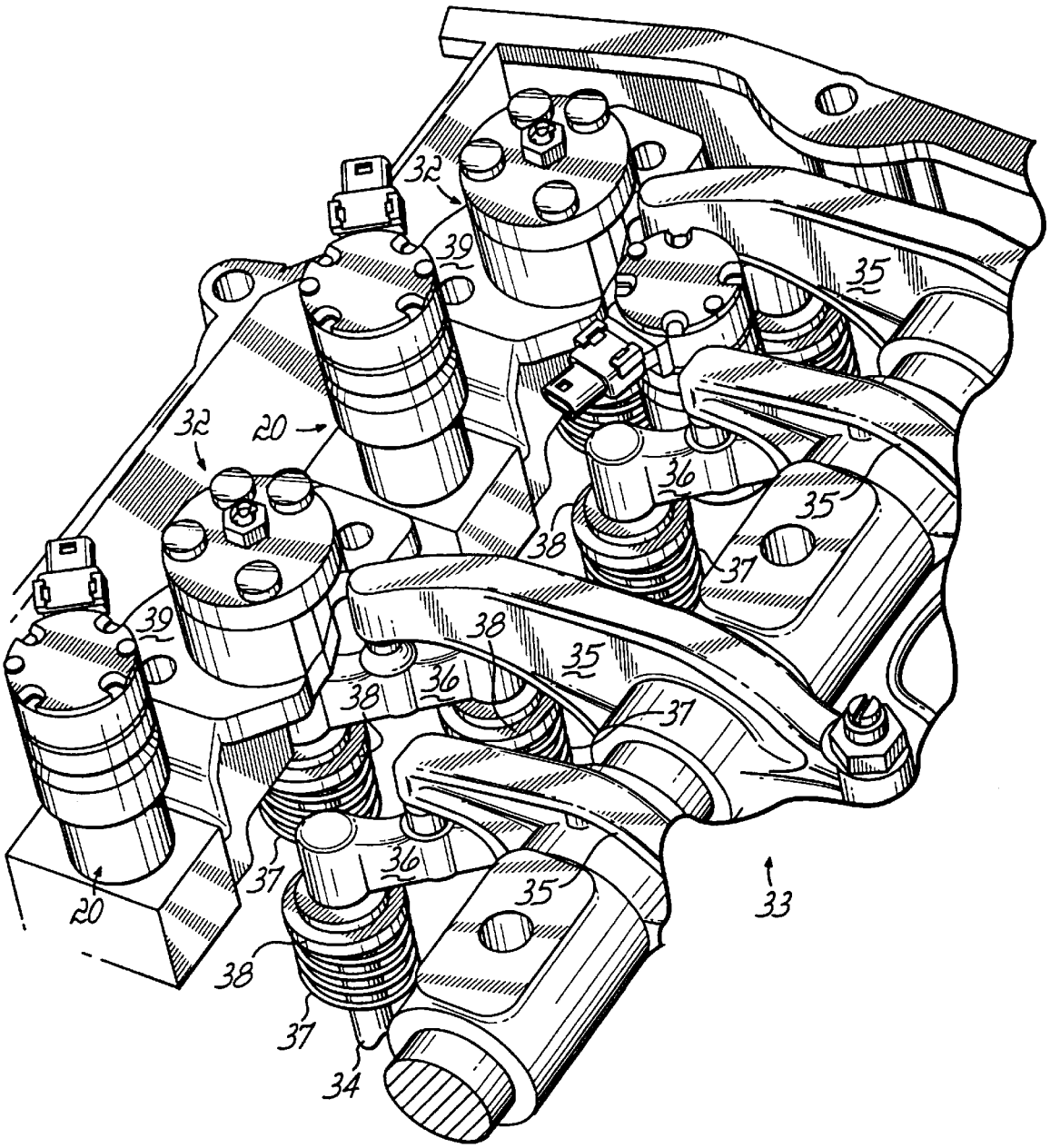
FIG. 2 is a partial perspective view illustrating one embodiment of the exhaust valve electrohydraulic actuator of FIG. 1.

FIG. 2 is a partial perspective view illustrating one embodiment of the exhaust valve electrohydraulic actuator 20 of the invention. A rocker arm assembly 33 has a plurality of independently pivoting rocker arms 35 which are normally operated directly or indirectly by lobes of a camshaft (not shown) in a known manner. It should be noted that FIG. 2 is presented to show the operation of an exhaust valve system and therefore, is not a comprehensive representation of the full rocker arm assembly 33. Generally, some rocker arms operate intake valves, and other rocker arms operate exhaust valves. The distal end of the rocker arm 35 is typically in mechanical communication with a center portion of a bridge 36 having two ends. Each end of the bridge is in mechanical communication with an end of a stem of an exhaust valve 34. A valve return spring 37 is associated with each exhaust valve 34 and biases the exhaust valve 34 towards its closed position. A valve return spring clip or retainer 38 is secured onto the end of the stem of the exhaust valve 34 in a known manner.

Figure 3A:
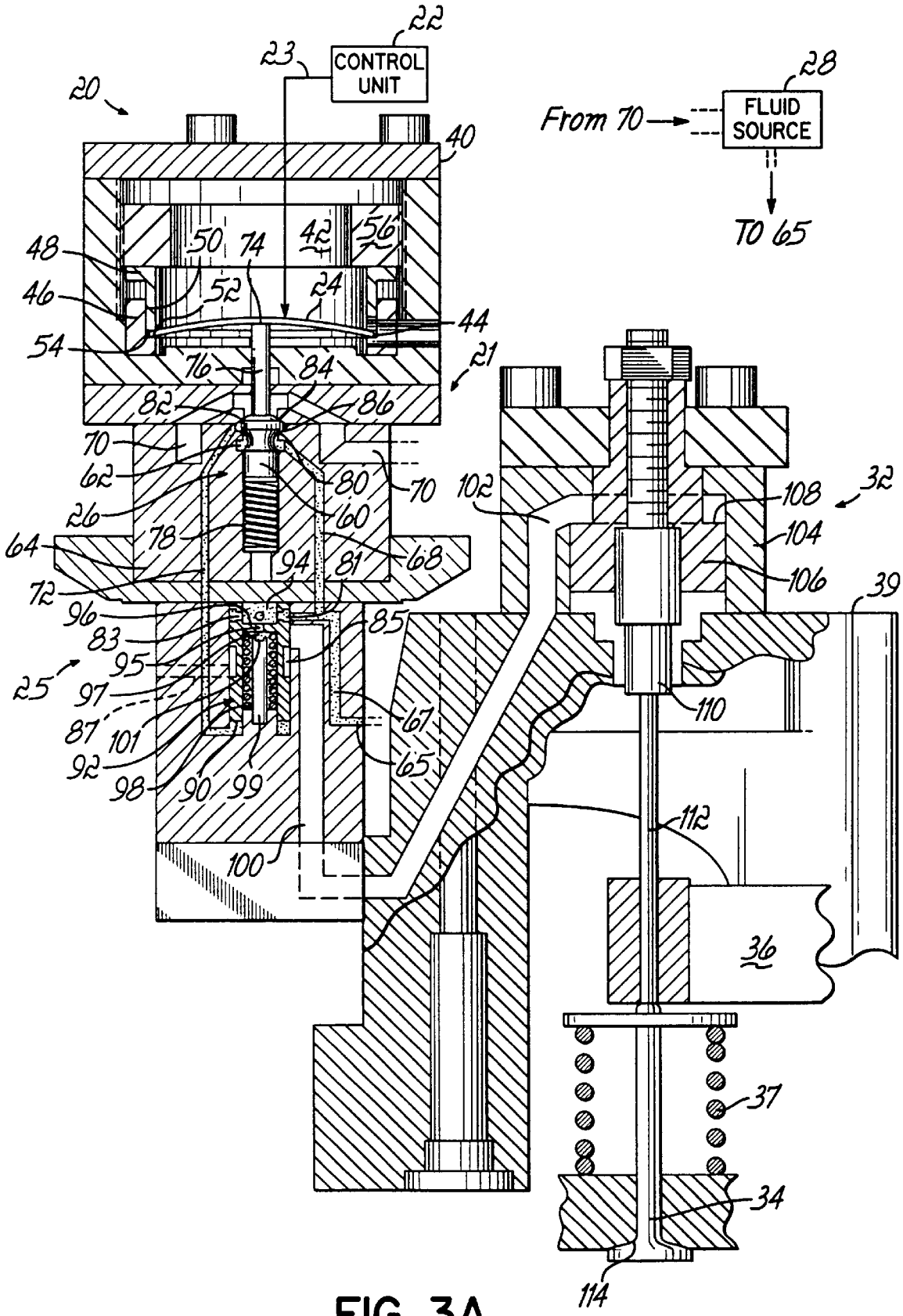
FIGS. 3A and 3B are schematic cross-sectional illustrations of the operation of one embodiment of the exhaust valve electrohydraulic actuator of FIG. 1.

Referring to FIG. 3A, in one embodiment of the invention, the exhaust valve actuator 32 is mounted on a body or pedestal 39 and is in mechanical communication with the end of the stem of the exhaust valve 34. An actuator drive 25 may also be mounted on the pedestal 39 and responds to electric or other signals received from an output 23 of the control unit 22. The pedestal 39 supports the actuator drive 25 and actuator 32 in their proper positions with respect to exhaust valve 34. The actuator drive 25 causes the exhaust valve actuator 32, such as a piston and cylinder for example, to operate, thereby opening and closing the exhaust valve 34.

Figure 3B:
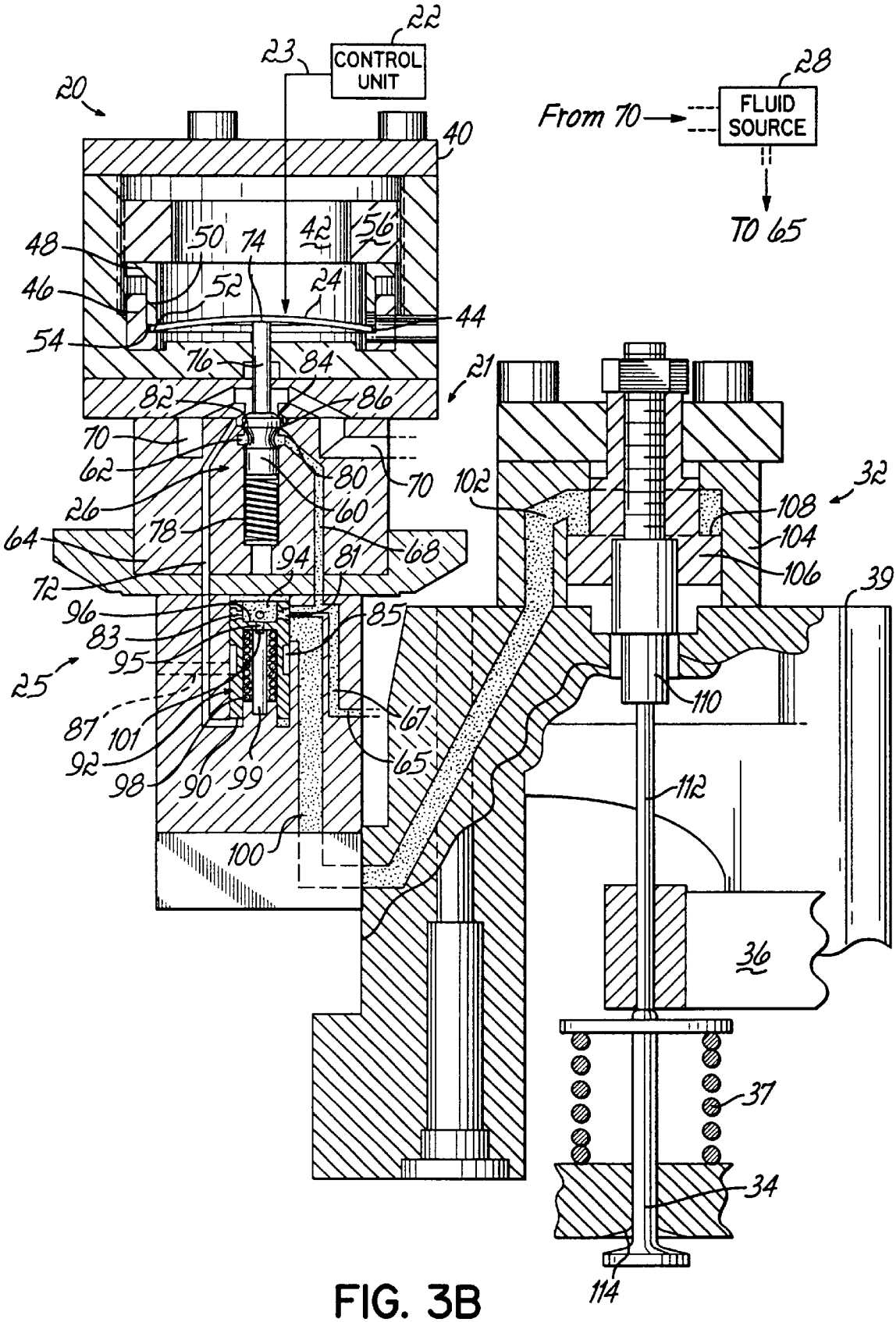

FIG. 3A illustrates one embodiment of the invention in which the exhaust valve 34 is operated in response to actuation of the TPEB actuator 24. In accordance with the principles of the present invention, the TPEB actuator 24 comprises a thermally pre-stressed electroactive bender actuator that changes its shape by deforming in opposite axial directions in response to a control signal applied by the control unit 22. The TPEB actuator 24 typically has a circular or disk configuration and includes at least one electroactive layer (not shown) positioned between a pair of electrodes (not shown), although other configurations are possible as well without departing from the spirit and scope of the present invention. In a first state, the TPEB actuator 24 is preferably thermally pre-stressed to have a domed configuration as shown in FIG. 3A. When the electrodes are energized to place the TPEB actuator 24 in a second state, the TPEB actuator 24 displaces axially to a less domed configuration as shown in FIG. 3B.

Examples of TPEB actuators 24 suitable for use in the present invention are described in U.S. Pat. Nos. 5,471,721 and 5,632,841. The TPEB actuator 24 also may be a model TH-5C commercially available from Face International, Inc. of Norfolk, Va. Other appropriate actuators may also be used. One or more TPEB actuators 24 may comprise a plurality of benders actuators (configured in parallel or in series) that are individually stacked or bonded together into a single multi-layered element.

The TPEB actuator 24 is disposed within a cavity 42 within the housing 40 and is supported at its peripheral edge 44 between lower and upper clamp rings 46, 48, respectively. The clamp rings are normally made from a stiff electrically nonconductive material. The lower clamp ring 46 is generally L-shaped and has a generally cylindrical inner locating surface 50 that locates the peripheral edge 44 of the TPEB actuator 24. The lower clamp ring 46 has an annular support surface 52 that supports one side of the TPEB actuator 24 around its peripheral edge 44. The upper clamp ring 48 is also generally L-shaped and has a bearing surface 54 that contacts an opposite side of the TPEB actuator 24 around its peripheral edge 44.

The TPEB actuator 24 is prestressed with a clamping force, typically, between about 0.1 and 300 Newton's, depending on the application. A load ring 56 threadedly engaged within the cavity 42 supplies the clamping force. As the load ring 56 is tightened and loosened, the application of the clamping force is respectively increased and decreased on the peripheral edge 44 of the TPEB actuator 24 via the upper clamp ring 48. In the embodiment of FIG. 3A, the load ring 56 applies a clamping force around the whole peripheral edge 44 of the TPEB actuator 24. Increasing the clamping force on the TPEB actuator 24 reduces an axial displacement of the TPEB actuator 24 in response to a given control signal magnitude. Decreasing the clamping force results in a greater displacement.

As will be appreciated, in an alternative embodiment, the bearing surface 54 of the upper clamp ring 48 may be notched or cut out at different locations around its circumference. Thus, no clamping force is applied directly to the portions of the peripheral edge 44 of the TPEB actuator 24 that are beneath the cut outs in the bearing surface 54 of the upper clamp ring 48. In other embodiments, the TPEB actuator peripheral edge 44 can be loaded with a spring or by other means.

The hydraulic pilot valve 26 is comprised of a movable valve 60, such as a poppet valve for example, disposed in a cavity 62 of a valve body 64 on which the housing 40 is mounted. The hydraulic pilot valve 26 of FIG. 3A is a three-way two-position valve. As will be appreciated other comparable functioning valves may be used in place of the poppet 60.

The housing 40 has an inlet port 65 fluidly coupled with the pressurized hydraulic fluid source 28 (FIG. 1). Hydraulic fluid provided under a pressure from the pressurized hydraulic fluid source 28 passes through first and second internal fluid passages 67, 68, respectively, that intersect cavity 62 of the housing 40. Hydraulic fluid is returned to the fluid source 28 via drain passages 70 that also intersects the cavity 62. Operation of the hydraulic pilot valve 26 connects either the supply passage 68 or the drain passage 70 to a control passage 72. As will be appreciated, the two-dimensional depiction of the passages 68, 70, 72 in FIG. 3A are schematic in nature. Often the hydraulic pilot valve 26 is manufactured such that the passages 68, 70 and 72 intersect the cavity 62 at different circumferential locations of the cavity 62.

In FIG. 3A, the TPEB actuator 24 is illustrated in its domed first state or position; and the poppet valve 60 is shown in its first position. The first state of the TPEB actuator 24 is achieved in response to the control unit 22 providing a first command signal to the TPEB actuator 24, such as a DC biasing voltage of a first polarity. When in that state, a center portion 74 of the TPEB actuator 24 is displaced vertically upward to a flexed or domed position. An actuating pin or portion 76 of the poppet valve 60 is mechanically biased against a lower side of the center portion 74 of the TPEB actuator 24 by a biasing element, such as a return spring 78 for example. As will be appreciated, in alternative embodiments, the actuating pin may be attached to the lower side of the of the center portion 74 of the TPEB actuator 24 by a fastener, bonding agent or other means. With such embodiments, the return spring 78 can be eliminated.

The actuating pin 76 is normally made from an electrically nonconducting material, such as zirconia for example. As will be appreciated, the actuating pin may be fabricated from other electrically insulating materials known to those who are skilled in the art. Alternatively, the end of the actuating pin 76 that is in contact with the TPEB actuator 24 may be constructed to have an electrically nonconductive tip with the remainder of the actuating pin 76 being made of a conductive material. In an alternative embodiment, the actuating pin may be made of a conductive material, and a nonconductive coating applied to at least the center portion 74 the lower side.

In the first position, the poppet valve 60 has a first annular sealing area 80 that is separated from an annular lower seat 82 on the valve body 64. Therefore, pressurized hydraulic fluid is released to flow from the supply passage 68 to the control passage 72. When in the first position, the poppet valve 60 has a second annular sealing area 84 that is engaged with an annular upper seat 86, thereby blocking the flow of hydraulic fluid from the control passage 72 to the drain passage 70.

When in a first position illustrated in FIG. 3A, the poppet valve 60 provides fluid communication between the supply passage 68 and the control passage 72 that in turn, provides hydraulic fluid to a bottom end 90 of a spool valve 92. The supply passage 68 also intersects an external annular passage or annulus 81 on the spool valve 92. Holes 83 provide a fluid connection between the annulus 81 and a fluid cavity 94 contiguous with an upper end 96 of the spool valve 92. Thus, the supply passage 68 provides pressurized fluid to the cavity 94. A hole 95 is centrally located through the spool valve upper side 96 and intersects a cavity 97 inside the spool valve 92. The hole 95 permits pressurized hydraulic fluid to flow into the cavity 97 and apply a force opposite the force applied by the pressurized hydraulic fluid on the spool valve upper side 96. In that way, the forces exerted by the pressurized hydraulic fluid on the lower and upper ends, 90, 96, respectively, can be balanced.

With equal fluid pressures on its bottom and upper ends 90, 96, respectively, the spool valve 92 is biased toward a first, closed position illustrated in FIG. 3A by a biasing element 98, such as a return spring for example. With the spool valve 92 closed, hydraulic fluid in the supply passage 68 is blocked from entering the top of the fluid passage 100; and therefore, there is no fluid under pressure applied to the exhaust valve actuator 32. Thus, the return spring 37 holds the exhaust valve 34 in its closed position. With the spool valve 92 in its upper, closed position, the fluid passage 100 is fluidly connected to an annular fluid path or annulus 85 that in turn intersects a drain line 87. Thus, any fluid pressure in the fluid path 100 is relieved when the spool valve 92 is in its upper, closed position.

As shown in FIG. 3A, the actuator drive controls a supply of pressurized hydraulic fluid to the exhaust valve actuator 32. The fluid passage 100 extends through the actuator drive 25 and its supporting pedestal 39 and intersects fluid passage 102 within the actuator body 104 of actuator 32. In this embodiment of the invention, the actuator 32 typically comprises a piston 106 slidably mounted within the actuator body 104. The fluid passage 102 is fluidly coupled with an upper end 108 of the piston 106. A lower end or side 110 of the piston 106 is mechanically coupled with one end of an actuator pin 112. An opposite end of the actuating pin 112 extends through one end of the bridge 36 and is mechanically coupled with an end of the stem of the exhaust valve 34. The exhaust valve 34 is biased to its closed position by the return spring 37. In a state illustrated in FIG. 3A, the absence of pressurized fluid from the pressurized hydraulic fluid source 28 in the fluid paths 100, 102 permits the exhaust valve 34 to remain in its closed position as biased by the spring 37. Thus, with the TPEB actuator 24 in its illustrated first or domed state, the exhaust valve 34 is operated by the action of the bridge 36 as required during a normal engine operation.

When it is desired to change the state of the hydraulic pilot valve 26, the electronic control unit 22 provides a second command signal to the TPEB actuator 24, such as a DC biasing voltage of a second, typically opposite polarity as the first command signal. Referring to FIG. 3B, in one embodiment of the invention, the second command signal causes the TPEB actuator 24 to flex in a first direction, such as a generally vertically downward direction to a less domed or slightly domed position. The downward movement of the TPEB actuator 24 overcomes the biasing force of the return spring 78 as the TPEB actuator 24 moves to its second position or state.

Movement of the TPEB actuator 24 downward pushes the actuator portion 76 and the poppet 60 downward to its second position. With the poppet valve 60 at its second position, the first annular sealing area 80 engages the annular lower seat 82 on the valve body 64, and pressurized hydraulic fluid from the supply passage 68 is blocked from the control passage 72. Further, the second annular sealing area 84 is separated from the annular upper seat 86, thereby opening the control passage 72 to the drain passage 70. Thus, hydraulic pressure is removed from the bottom end or side 90 of the spool valve 92. The pressure head in the cavity 94 on the upper end or side 96 of the spool valve 92 overcomes the force exerted by the return spring 98, and the spool valve 92 moves vertically downward to a second, open position. Movement of the spool valve 92 downward forces hydraulic fluid from the cavity 97, through the hole 95 and into the cavity 94. A stationary spool pin 99 positively stops the downward movement of the spool valve 92.

A displacement of the spool valve 92 to its lower, open position shown in FIG. 3B terminates the fluid connection between the fluid path 100 and the annulus 85 and drain 87. Further, displacement of the spool valve 92 downward opens a fluid path via annulus 81 between the supply passage 68 and the top of the fluid passage 100. Thus, pressurized hydraulic fluid from the pressurized hydraulic fluid source 28 is applied to fluid passages 100, 102 and the upper end 108 of the piston 106. A force sufficient to overcome the force of the return spring 37 is generated, and the piston 106 and actuator pin 112 are moved in a vertically downward direction, thereby moving the valve 34 to the illustrated open position. The opening of the exhaust valve 34 is effected independent of the operation of the bridge 36 and thus, can be used to execute a compression braking cycle.

The exhaust valve electrohydraulic actuator 20 typically remains in the state illustrated in FIG. 3B until the electronic control unit 22 determines that the exhaust valve 34 is to be closed. It should be noted that if the second command signal is removed, e.g., reduced to a zero voltage, the capacitive behavior of the TPEB actuator 24 causes it to temporarily remain in the position illustrated in FIG. 3B for some period of time. Therefore, substantially less power is required to maintain the TPEB actuator 24 than other actuators, such as a solenoid for example.

When the valve 34 is to be closed, the electronic control unit 22 again provides the first command signal on its output 23 to the TPEB actuator 24. The first command signal causes the TPEB actuator 24 to move in a second direction opposite the first direction, such as a generally vertically upward direction as viewed in FIG. 3B, to its first, more domed, prestressed position or state as illustrated in FIG. 3A. As the TPEB actuator 24 moves upward, the return spring 78 moves the poppet valve 60 upward, such that the actuating pin 76 remains in contact with the center portion 74 of the TPEB actuator 24.

Movement of the poppet valve 60 vertically upward back to its first position closes or terminates fluid communication between the control passage 72 and the drain passage 70 and opens the control passage 72 to the supply passage 68. Pressurized hydraulic fluid in the control passage 72 applies a force against the bottom end 90 of the spool valve 92. That force in combination with the force of the return spring 98 overcomes the force of the pressurized hydraulic fluid on the upper side 96 of the spool valve 92. However, a slot 101 in the top of the stationary spool pin 99 facilitates the flow of hydraulic fluid through the hole 95 and into the forming cavity 97. Thus, as the spool valve 92 moves from its open position, the fluid pressure forces on the bottom and top ends 90, 96, respectively, quickly equalize to a balanced state.

With the hydraulic pressure on the spool valve 92 balanced, the return spring 98 holds the spool valve 92 in its closed position. Closing the spool valve 92 terminates the application of pressurized hydraulic fluid to the fluid passages 100, 102 and the upper end or side 108 of the piston 106. Further, the fluid path 100 is connected to the drain 87 via the annulus 85, thereby relieving any hydraulic fluid pressure in the fluid path 100. The valve return spring 37 is then able to apply a force against the lower end 110 of the piston 106, which is greater than the reduced fluid pressure force on the upper end 108 of the piston 106. Thus, the return spring 37 moves the valve 34 and piston 106 in the generally upward direction, and the valve 34 returns to its closed position.

Figure 4A:
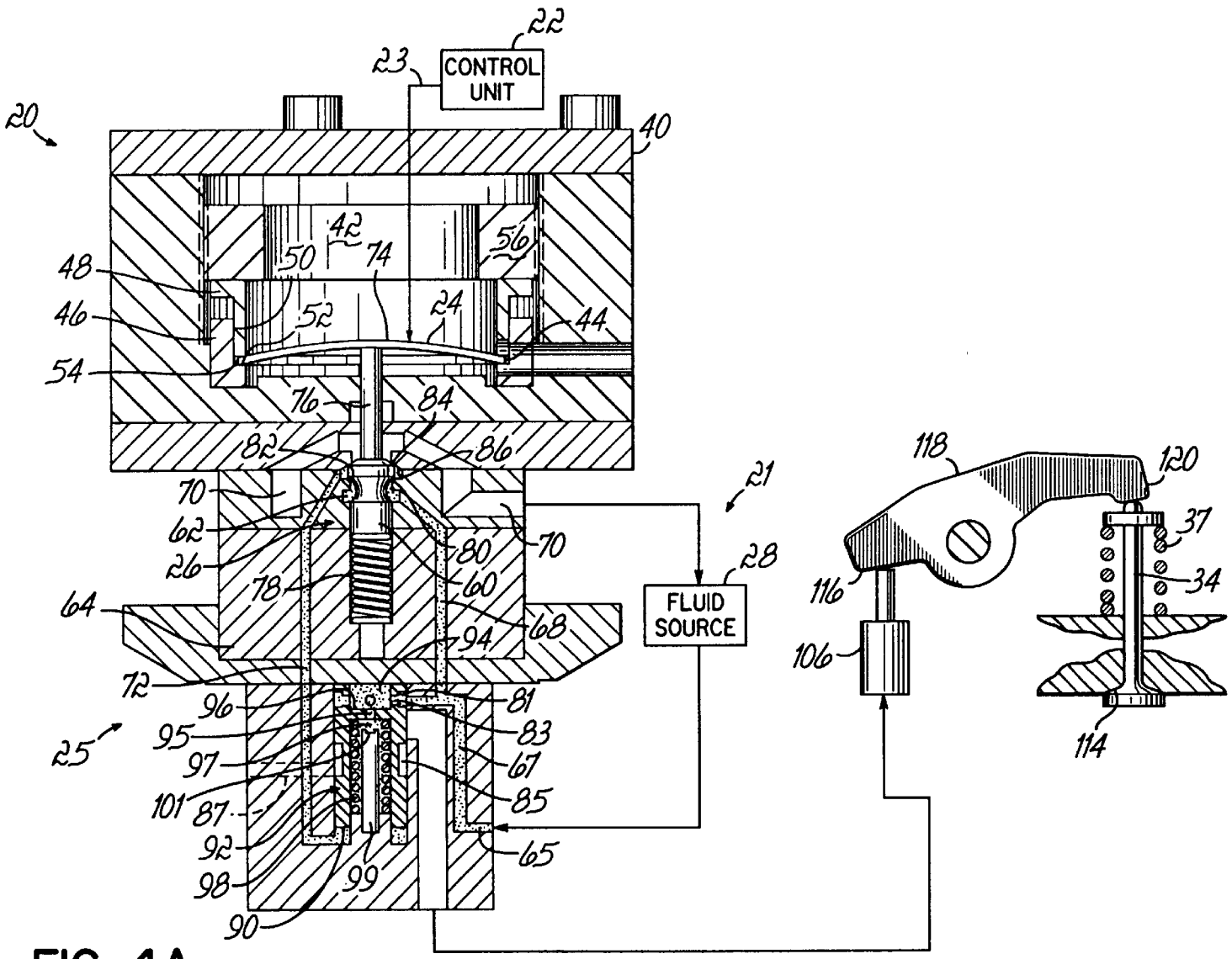
FIGS. 4A and 4B are schematic cross-sectional illustrations of the operation of an alternative embodiment of the exhaust valve electrohydraulic actuator of FIG. 1.
Figure 4B:
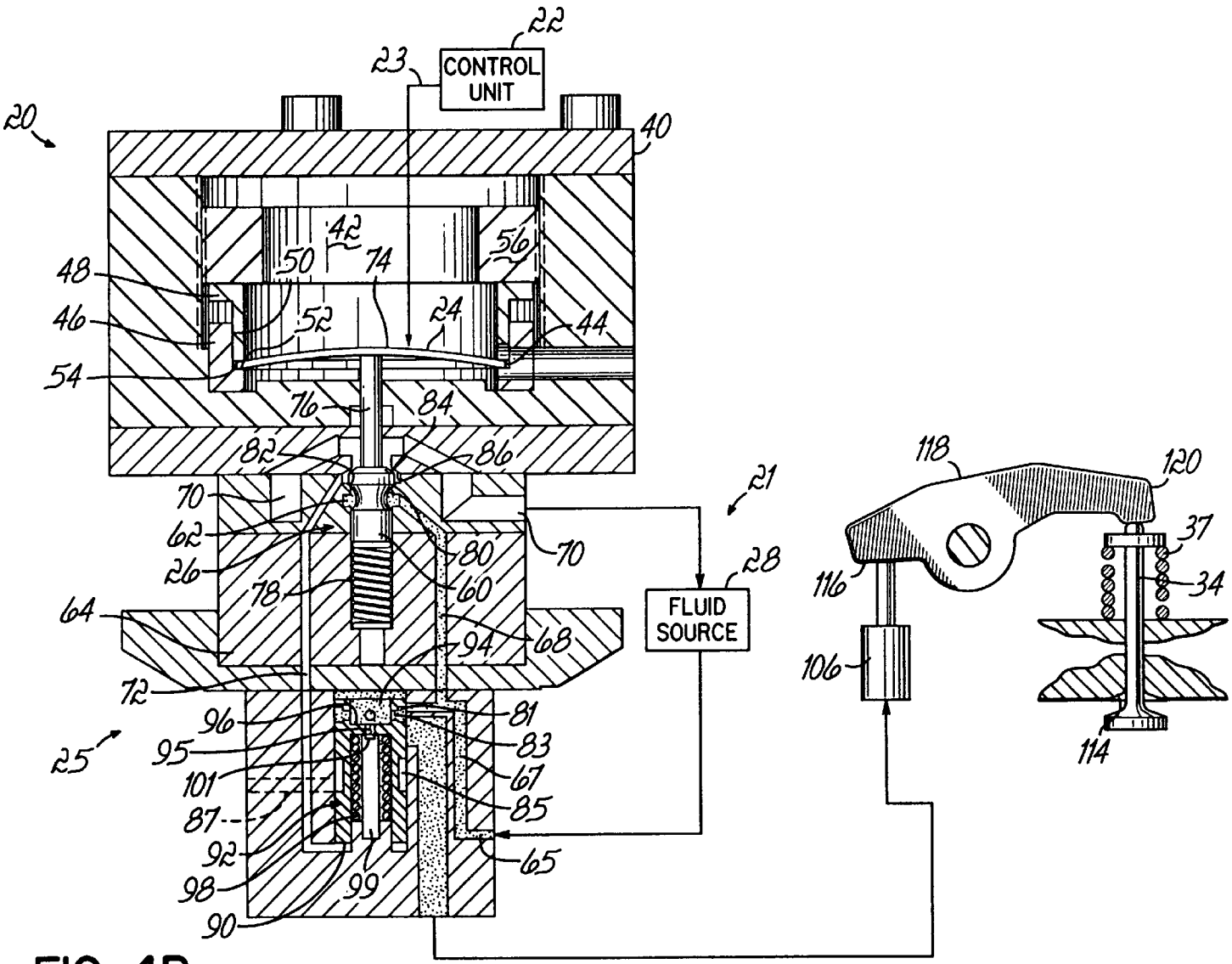

The embodiment illustrated in FIGS. 3A–3B provides a controllable exhaust valve electrohydraulic actuator 20 that directly operates an exhaust valve 34 independent of the rocker arm assembly 33 including the bridge 36. As will be appreciated, the exhaust valve electrohydraulic actuator 20 of FIG. 1 may be used in an alternative embodiment as illustrated in FIGS. 4A and 4B. The operation of the actuator drive 25 is similar to that described with respect to FIGS. 3A and 3B. The actuator 32 operates similarly to that described with respect to FIGS. 3A and 3B; however, the piston 106 of actuator 32 is mechanically coupled with one end 116 of the rocker arm 118. The opposite end 120 of the rocker arm 118 is mechanically coupled with an end of the stem of the exhaust valve 34 in a known manner. Thus, in this embodiment, the electronic control unit 22 provides command signals to operate the TPEB actuator 24, hydraulic pilot valve 26 and main valve 30, so that hydraulic fluid is ported to the exhaust valve actuator 32, thereby causing the exhaust valve actuator 32 to raise and lower the rocker arm 118 and respectively open and close the exhaust valve 34.

The exhaust valve electrohydraulic actuator 20 of FIGS. 3 and 4 is illustrated as being applied to a single exhaust valve; however, as will be appreciated, in other embodiments of the invention, the exhaust valve electrohydraulic actuator 20 can be replicated for each exhaust valve to be controlled. Similarly, in other embodiments of the invention, the actuator 20 may control multiple exhaust valves. Further, while the above-described embodiment uses the TPEB actuator 24 to operate the exhaust valve 34, as will be appreciated, the TPEB actuator 24 may be used to operate any of a variety of other actuators found on a vehicle and known to those who are skilled in the art.

The TPEB actuator 24 is a bidirectional device. As will be appreciated, in an alternative embodiment, a hole may be formed in the center portion 74 of the TPEB actuator 24; and an end of the actuating pin 76 may be attached to the center portion 74 of the TPEB actuator 24. Thus, the poppet valve 60 can be moved in opposite directions by applying the appropriate command signals to the TPEB actuator 24 as previously described. This embodiment allows for either the elimination of a return spring or the use of a substantially smaller return spring. As will be appreciated, in this embodiment, adhesives or other bonding means may also be used to connect the end of the actuating pin 76 to the center portion 74 of the TPEB actuator 24. Again, once in that state, the second command signal or bias can be removed, and the capacitive behavior of the TPEB actuator 24 causes it to remain temporarily in the position illustrated in FIG. 3A.

In the operation of the exhaust valve 34 described in the embodiments herein, the operation of the return spring 37 typically moves the exhaust valve 34 with a relatively high force. Thus, the exhaust valve 34 typically impacts the valve seat 114 at a relatively high velocity. Such repeated high velocity impact of the exhaust valve 34 on the seat 114 causes wear and reduces the life of the exhaust valve 34. The TPEB actuator 24 is a proportional and bidirectional actuator, and those features can be used to cushion or reduce the impact of the exhaust valve 34 on the seat 114.

After the second command signal is provided to the TPEB actuator 24 to move it back toward its first position as illustrated in FIG. 3A, the exhaust valve 34 is moved towards the seat 114 by the return spring 37. As the exhaust valve 34 moves toward its seat, the electronic control unit 22 may apply a third command signal or bias similar to, but typically of a reduced magnitude than, the first command signal. The third command signal causes the TPEB actuator 24 to move through a small displacement downward to an intermediate less domed third position. This movement allows the poppet valve 60 to move slightly which permits a slight bleeding of fluid pressure through the drain passage 70 and a slight movement of the spool valve 92 downward.

The slight movement of the spool valve 92 reapplies pressurized hydraulic fluid to the fluid paths 100, 102 and the upper end or side 108 of the piston 106. This operation provides a resistance force on the piston 106 against the operation of the return spring 37 moving the exhaust valve 34 to the closed position. With the resistance force, the velocity of the exhaust valve 34 is reduced, as is the impact force of the exhaust valve 34 on the seat 114. As will be appreciated, the electronic control unit 22 can provide command signals to the TPEB actuator 24 that control the position, velocity and/or acceleration of the TPEB actuator 24 in order to more precisely control the operation of the exhaust valve 34 in moving to the opened and closed positions.

Industrial Applicability

The present invention provides an exhaust valve electrohydraulic actuator 20 using a TPEB actuator 24 as a mechanical power source for the exhaust valve electrohydraulic actuator 20. The TPEB actuator 24 is physically small, uses relatively little power, has very fast response times and has a proportionally controllable bidirectional operation. Thus, an exhaust valve electrohydraulic actuator 20 is provided in which the exhaust valve operation with respect to the engine combustion cycle is virtually unlimited.

Further, the use of a TPEB actuator 24 in an exhaust valve electrohydraulic actuator 20 provides significant advantages over electromagnetic solenoids. First, its small mass and low inertia provides the TPEB actuator 24 with extremely fast response times, such as about 150 microseconds. The fast response time TPEB actuator 24 reduces the indeterminate time that the exhaust valve 34 is between states and provides a reduced cycle time in the operation of the exhaust valve 34. The reduced cycle time of the exhaust valve 34 has the advantage of providing a more consistent and less variable operation of the exhaust valve 34, thereby resulting in a more consistent, predictable and reliable operation of the engine.

Thus, in a normal engine compression braking mode, the exhaust valve 34 can be closed by the rocker arm assembly 33 during the compression stroke in a normal manner. However, when the piston is close to the top-dead-center position, the exhaust valve 34 can be opened independently of the rocker arm assembly 33 using the TPEB actuator 24. The fast response time of the TPEB actuator 24 results in the exhaust valve 34 being opened at precisely the same time with each compression stroke. This high degree of precision and repeatability in the operation of the exhaust valve 34 results in a consistent and highly effective engine compression braking.

Further, the fast response time of the TPEB actuator 24 permits operation of the exhaust valve over very short intervals. Thus, the engine exhaust valve actuator 32 can perform multiple cycles of the exhaust valve 34 within a single engine cycle. This capability is especially useful in performing the alternate mode of engine compression braking in which the exhaust valve 34 is opened twice during a compression stroke. Again, the fast response time the TPEB actuator 24 provides a more precise and repeatable operation of exhaust valve 34, thereby providing a more consistent and effective engine compression braking event.

A TPEB actuator 24 has a further advantage of having a capability of proportional, bidirectional operation. Thus, the TPEB actuator 24 allows for very precise positioning of the hydraulic pilot valve 26, thereby providing a very precise control of the main valve 30. Precise control of the main valve 30 permits a precise control of the exhaust valve actuator 32 and exhaust valve 34.

In addition, the capability of proportional bidirectional control provides an exhaust valve electrohydraulic actuator 20 that has the capability of adjusting the velocity of the exhaust valve 34 as it returns to its seat 114 upon closing. In this application, the pilot stage 26 can be operated to move the main valve 30 slightly in a direction to slow the return of the exhaust valve 34 right before it reaches its seat 114, thereby cushioning the impact of the exhaust valve 34.

The TPEB actuator 24 has a still further advantage in that it draws considerably less power than an electromagnetic solenoid. Further, due to its capacitive behavior, a TPEB actuator 24 draws no power during a hold period where actuation is temporarily maintained for a period of time.

Although the TPEB actuator 24 is somewhat limited in force capability, multiple TPEB actuators may be easily combined in a stacked, parallel manner to provide a greater force that is approximately linearly related to the number of actuators in the stack. In addition, TPEB actuators may be combined in a serial manner to increase the magnitude of the stroke, that is, the displacement. Even in a stacked arrangement, TPEB actuators are relatively small and take up substantially less space than electromagnetic solenoids.

Even though the above describes an exhaust valve electrohydraulic actuator 20 that uses a TPEB actuator 24, those of ordinary skill in the art will appreciate that the exhaust valve electrohydraulic actuator 20 is readily adaptable for use in a wide range of applications without departing from the spirit and scope of the present invention.

While the present invention has been illustrated by a description of various embodiments, and while these embodiments have been described in considerable detail, it is not the intention of Applicants to restrict or in any way limit the scope of the appended claims to such detail. Additional advantages and modifications will readily appear to those skilled in the art.

Thus, the invention in its broader aspects is, therefore, not limited to the specific details, representative apparatus and method, and illustrative example shown and described. Accordingly, departures may be made from such details without departing from the spirit or scope of Applicants' general inventive concept.

Other aspects and features of the present invention can be obtained from a study of the drawings, the disclosure, and the appended claims.

What is claimed is:

1. An apparatus for operating an exhaust valve of an internal combustion engine, the apparatus comprising:

a thermally prestressed electroactive bender actuator configured to receive a command signal and responsively move between first and second positions; and an exhaust valve actuator system coupled with the thermally prestressed electroactive bender actuator and the exhaust valve, the exhaust valve actuator system configured to operate the exhaust valve as a function of the thermally prestressed electroactive bender actuator moving between the first and second positions;

wherein the exhaust valve actuator system includes an actuator drive coupled with the thermally prestressed electroactive bender actuator, the actuator drive having at least one hydraulically actuated valve.

2. The apparatus of claim 1 wherein the exhaust valve actuator system is operable to open and close the exhaust valve as a function of the thermally prestressed bender actuator moving between the first and second positions.

3. The apparatus of claim 1 wherein the actuator drive is operable to change state as a function of the thermally prestressed electroactive bender actuator moving between the first and second positions, and further including;

an exhaust valve actuator coupled with the actuator drive and the exhaust valve, the exhaust valve actuator operable to operate the exhaust valve as a function of the actuator drive changing state.

4. The apparatus of claim 3 wherein the actuator drive provides a flow of a pressurized fluid representing a first state in response to the thermally prestressed electroactive bender actuator moving from the first position to the second position, and the actuator drive terminates the flow of a pressurized fluid representing a second state in response to the thermally prestressed electroactive bender actuator moving from the second position to the first position.

5. The apparatus of claim 4 wherein the exhaust valve actuator opens the exhaust valve in response to the flow of the pressurized fluid and closes the exhaust valve in response to an absence of the flow of the pressurized fluid.

6. The apparatus of claim 1 wherein the least one hydraulically actuated valve comprises:

a pilot valve coupled with the thermally prestressed electroactive bender actuator, the pilot valve operable to switch between first and second operating states as a function of the operating states of the thermally prestressed electroactive bender actuator; and a main valve coupled with the pilot valve, the main valve operable to switch between first and second operating states as a function of the operating states of the pilot valve.

7. The apparatus of claim 6 wherein the pilot valve is mechanically coupled with the thermally prestressed electroactive bender actuator and the pilot valve is moved by the thermally prestressed electroactive bender actuator moving between the first and second positions.

8. The apparatus of claim 7 wherein the pilot valve is fluidly coupled with the main valve, and the main valve is operable to control a supply of pressurized fluid to the exhaust valve actuator to operate the exhaust valve as a function of the pilot valve being moved by the thermally prestressed electroactive bender actuator moving between the first and second positions.

9. The apparatus of claim 6 wherein the thermally prestressed electroactive bender actuator moves through a displacement in a first direction in response to a first command signal.

10. The apparatus of claim 9 wherein in response to the thermally prestressed electroactive bender actuator moving through a displacement in the first direction, the pilot valve moves in a first direction, the pilot valve operable to cause the main valve to supply pressurized fluid to the exhaust valve actuator that, in turn, is operable to cause the exhaust valve to open.

11. The apparatus of claim 10 wherein the thermally prestressed electroactive bender actuator moves through a displacement in an opposite direction in response to a second command signal.

12. The apparatus of claim 11 wherein in response to the thermally prestressed electroactive bender actuator moving through a displacement in the opposite direction, the pilot valve moves in an opposite direction, thereby causing the main valve to terminate a supply of pressurized fluid to the exhaust valve actuator, whereby the exhaust valve is closed.

13. The apparatus of claim 6 wherein the pilot valve comprises a poppet valve.

14. An apparatus for operating an exhaust valve of an internal combustion engine in response to command signals to provide engine compression braking, the apparatus comprising:

a thermally prestressed electroactive bender actuator operable to move through displacements in two different directions as a function of the command signals; and an exhaust valve actuator system coupled with the thermally prestressed electroactive bender actuator operable to operate the exhaust valve, the exhaust valve actuator system including an actuator drive having at least one hydraulically actuated valve, and operating the exhaust valve as a function of the thermally prestressed electroactive bender actuator moving through the displacements, the thermally prestressed electroactive bender actuator and the exhaust valve actuator system operable to operate the exhaust valve to effect engine compression braking.

15. The apparatus of claim 14 wherein the thermally prestressed electroactive bender actuator is operable to move through a displacement in a first direction as a function of a first command signal and to move through a displacement in a second direction as a function of a second command signal.

16. The apparatus of claim 14 wherein the exhaust valve actuator system is operable to move the exhaust valve to an open position as a function of the thermally prestressed electroactive bender actuator moving through a displacement in the first direction, and to move the exhaust valve to a closed position as a function of the thermally prestressed electroactive bender actuator moving through a displacement in the second direction.

17. The apparatus of claim 16 wherein the thermally prestressed electroactive bender actuator is operable to move through a first displacement in the first direction as a function of a first command signal and to move through a second displacement in the first direction as a function of a third command signal.

18. An apparatus for operating an exhaust valve of an internal combustion engine in response to a command signal to provide engine compression braking, the apparatus comprising:

a control unit operable to provide a plurality of command signals indicative of engine braking;

a thermally prestressed electroactive bender actuator electrically connected with the control unit to receive the plurality of command signals, the thermally prestressed bender actuator operable to move through a plurality of displacements in two different directions as a function of the command signals; and an exhaust valve actuator system coupled with the thermally prestressed electroactive bender actuator and the exhaust valve, the exhaust valve actuator system including an actuator drive having at least one hydraulically actuated valve, and operable to operate the exhaust valve as a function of the thermally prestressed electroactive bender actuator moving through the plurality of displacements, the thermally prestressed electroactive bender actuator and the exhaust valve actuator system operable to operate the exhaust valve to effect engine compression braking.

19. A method of operating an exhaust valve of an internal combustion engine, the method comprising:

applying the command signal to a thermally prestressed electroactive bender actuator;

switching the thermally prestressed electroactive bender actuator between first and second operating states as a function of the command signal; and switching at least one hydraulically actuated valve in an actuator drive in an exhaust valve actuator system between first and second operating states as a function of the thermally prestressed electroactive bender actuator switching between the first and the second operating states, the exhaust valve actuator system operating the exhaust valve as a function of the switching of the exhaust valve actuator system.

20. The method of claim 19 wherein switching the exhaust valve actuator system further comprises:

switching actuator drive between first and second operating states as a function of the thermally prestressed electroactive bender actuator switching between the first and the second operating states; and switching an exhaust valve actuator between first and second operating states as a function of the actuator drive switching between the first and the second operating states.

21. The method of claim 20 wherein switching the at least one hydraulically actuated valve further comprises:

switching a pilot valve between first and second operating states as a function of the thermally prestressed electroactive bender actuator switching between the first and the second operating states; and switching a main valve between first and second operating states as a function of the pilot valve switching between first and second operating states.

22. A method of operating an exhaust valve of an internal combustion engine in response to command signals to provide engine compression braking, the method comprising:

applying a first command signal to a thermally prestressed electroactive bender actuator;

moving the thermally prestressed electroactive bender actuator through a displacement in a first direction as a function of the first command signal; and supplying a pressurized fluid to at least one hydraulically actuated valve in an actuator drive in an exhaust valve actuator system as a function of the thermally prestressed electroactive bender actuator moving through the displacement in the first direction, the pressurized fluid operable to cause the exhaust valve to open, the thermally prestressed electroactive bender actuator and the exhaust valve actuator system operating the exhaust valve to effect engine compression braking.

23. The method of operating an exhaust valve of claim 22 wherein supplying a pressurized fluid to at least one hydraulically actuated valve comprises:

moving a pilot valve as a function of the thermally prestressed electroactive bender actuator moving through the displacement in the first direction; and opening a main valve to supply pressurized fluid to the exhaust valve actuator as a function of the pilot valve moving.

24. The method of operating an exhaust valve of claim 23 further comprising moving the pilot valve in the first direction in response to the thermally prestressed electroactive bender actuator moving in the first direction.

25. The method of claim 22 further comprising:

applying a second command signal to the thermally prestressed electroactive bender actuator;

moving the thermally prestressed electroactive bender actuator through a displacement in a second direction as a function of the second command signal; and terminating a supply of the pressurized fluid to the exhaust valve actuator as a function of the thermally prestressed electroactive bender actuator moving through the displacement in the second direction, the termination of pressurized fluid operable to cause the exhaust valve to close.

26. The method of operating an exhaust valve of claim 25 wherein terminating a supply of pressurized fluid comprises: moving the pilot valve as a function of the thermally prestressed electroactive bender actuator moving in the second direction; and closing the main valve to terminate the supply of pressurized fluid to the exhaust valve actuator as a function the pilot valve moving.

27. The method of operating an exhaust valve of claim 26 further comprising moving the pilot valve in the second direction in response to the thermally prestressed electroactive bender actuator moving in the second direction.

28. The method of claim 25 further comprising:

applying a third command signal to the thermally prestressed electroactive bender actuator; and moving the thermally prestressed electroactive bender actuator through a second displacement in the first direction as a function of the third command signal.

29. The method of operating an exhaust valve of claim 28 wherein the second direction is a direction opposite the first direction.

* * * * *